United States Patent [19]

Vilain

[11] 4,281,611

[45] Aug. 4, 1981

[54] SYSTEM FOR MOORING A SHIP, PARTICULARLY AN OIL-TANKER, TO AN OFF-SHORE TOWER OR COLUMN

[75] Inventor: Robert Vilain, Maisons-Alfort, France

[73] Assignee: Enterprise d'Equipment Mecaniques Hydrauliques E.M.H., France

[21] Appl. No.: 841,024

[22] Filed: Oct. 11, 1977

[30] Foreign Application Priority Data

Oct. 15, 1976 [FR] France ..... 76 31118

[51] Int. Cl.[3] ..... B63B 21/00

[52] U.S. Cl. ..... 114/230; 141/387; 9/8 P

[58] Field of Search ..... 141/382–388; 62/1; 9/8 P; 114/256, 257, 230, 264; 137/236 S

[56] References Cited

U.S. PATENT DOCUMENTS

| | | | |
|---|---|---|---|
| 2,648,201 | 8/1953 | Marancik | 62/1 |
| 3,442,245 | 5/1969 | Christians | 9/8 P |
| 3,572,408 | 3/1971 | Hnot | 114/230 |
| 3,727,652 | 4/1973 | Reynolds | 141/387 |
| 3,961,490 | 6/1976 | Corgnet | 9/8 P |
| 4,010,500 | 3/1977 | Reid | 114/230 |
| 4,090,538 | 5/1978 | Kotcharian | 9/8 P |

FOREIGN PATENT DOCUMENTS

| | | |
|---|---|---|
| 2276214 | 1/1976 | France . |
| 7019030 | 7/1962 | Netherlands . |
| 6710816 | 2/1968 | Netherlands . |

*Primary Examiner*—Trygve M. Blix
*Assistant Examiner*—D. W. Keen
*Attorney, Agent, or Firm*—Steinberg & Raskin

[57] ABSTRACT

A system for mooring a ship or like floating vessel, in particular, an oil-tanker, to an off-shore column, and for transferring a fluid cargo such as gas, petroleum oil or the like, by means of at least one articulated arm carried by the vessel, wherein the improvement consists in that the arm supports at its upper end a connector device capable of being fixedly placed on a mouth-piece, provided on the head of the column, and that mooring apparatus is provided to allow the vessel, once the connector device is thus placed, to be moored through the device and to move around the latter so as to be placed in the wind's eye.

7 Claims, 4 Drawing Figures

23
19
19
III
III
39
39
27
38
38
20'
12
26
24
22
18
21
25
35
29
37
28
20
5

SYSTEM FOR MOORING A SHIP, PARTICULARLY AN OIL-TANKER, TO AN OFF-SHORE TOWER OR COLUMN

The present invention relates to and has essentially for its object a system for mooring a ship or like floating vessel, particularly an oil-tanker, to an off-shore tower or column, e.g. fixedly or pivotally mounted on a sea bed or ocean floor, and at the same time for transferring a fluid, e.g. liquid cargo such as petroleum oil or the like.

Most of the solutions proposed hitherto provide for the mounting of most part of the mooring and connecting equipment on the tower top or platform. This is a complex equipment that requires maintenance works and therefore the presence of a certain personnel on the tower. Moreover, such maintenance is difficult to perform and may result in the equipment being unavailable over considerable periods of time.

In addition, the prior solutions require the use of a flexible connecting pipe which is often in direct contact with sea water and therefore liable to damage in heavy weather.

In order to obviate such drawbacks, it is suggested in accordance with the present invention, to place on the vessel the major part of the mooring and transfer equipment, so that practically all maintenance work can be carried out on the deck of the vessel, i.e. under shelter in port, and to leave on the tower or column only a connector device adapted to receive a complementary connector element pertaining to the said equipment, the tower thus being freed from any servicing crew.

According to a preferred form of embodiment of the invention the said equipment comprises at least one arm of suitable length pivotally mounted on the deck of the vessel about at least two orthogonal pivot axes, the said arm carrying at least one flexible or unflexible connecting pipe and being provided at its end with connector means adapted to be fitted onto a corresponding nipple or like fitting mouth-piece or head of the column.

Use can also be made of at least two arms movable with respect to one another and readily collapsible or foldable on the deck of the vessel, the said two arms being assembled together pivotally or even in telescoping relationship.

The mooring of the vessel may be performed by means of a hawser pivotally attached at one end to the vessel and at the other end to the column, in which case the said arm or one of the said arms is mounted on a carriage movable on rails provided on the deck.

If, however, the connector means are pivotally mounted at one end of the said arm, the latter (or the whole set of arms where several of them are provided) may fulfill the mooring function, thus either replacing the hawser or co-operating therewith, to which end the base supporting the system of arms on the deck may be so mounted, for example, as to be capable of resilient displacements ensuring a shock-absorbing or damping effect instead of the resiliency usually offered by the hawser. The relative motions of the vessel and the tower resulting from sea heave can thus be readily absorbed.

As regards the connector means provided at the end of the system of arms, they are obtained by means of an arrangement (apt to be applied, if suitable, to any other installation requiring a connection on a pipe mouth-piece or end) consisting in using an assembly comprising, on the one hand, a hollow body with a centring and guiding cone adapted to co-operate with the said fitting mouth-piece or head and, on the other hand, a sliding connector element suitably operated to engage into the said mouth-piece, thereby ensuring the connection, in conjunction with packing means, and lastly, locking means for maintaining the locking position.

The hawser, if any, is for example attached to a ring freely rotatable about the said device.

Apart from the above arrangements, the invention comprises other arrangements which are preferably used at the same time and will be more clearly explained later.

It is more particularly directed to certain forms of application, as well as certain forms of embodiment, of the said arrangements, and it is still more particularly directed, as novel industrial products, to systems of the kind in question involving application of these same arrangements, as well as the special elements appropriate to achieve the same, and the assemblies, more specially the towers or columns and the oil-tankers, comprising such systems and elements.

The invention will be better understood and other purposes, details and advantages of the latter will appear more clearly from the following explanatory description of a preferred form of embodiment of the invention, given solely by way of example with reference to the appended non-limitative drawings wherein.

Figure 1:
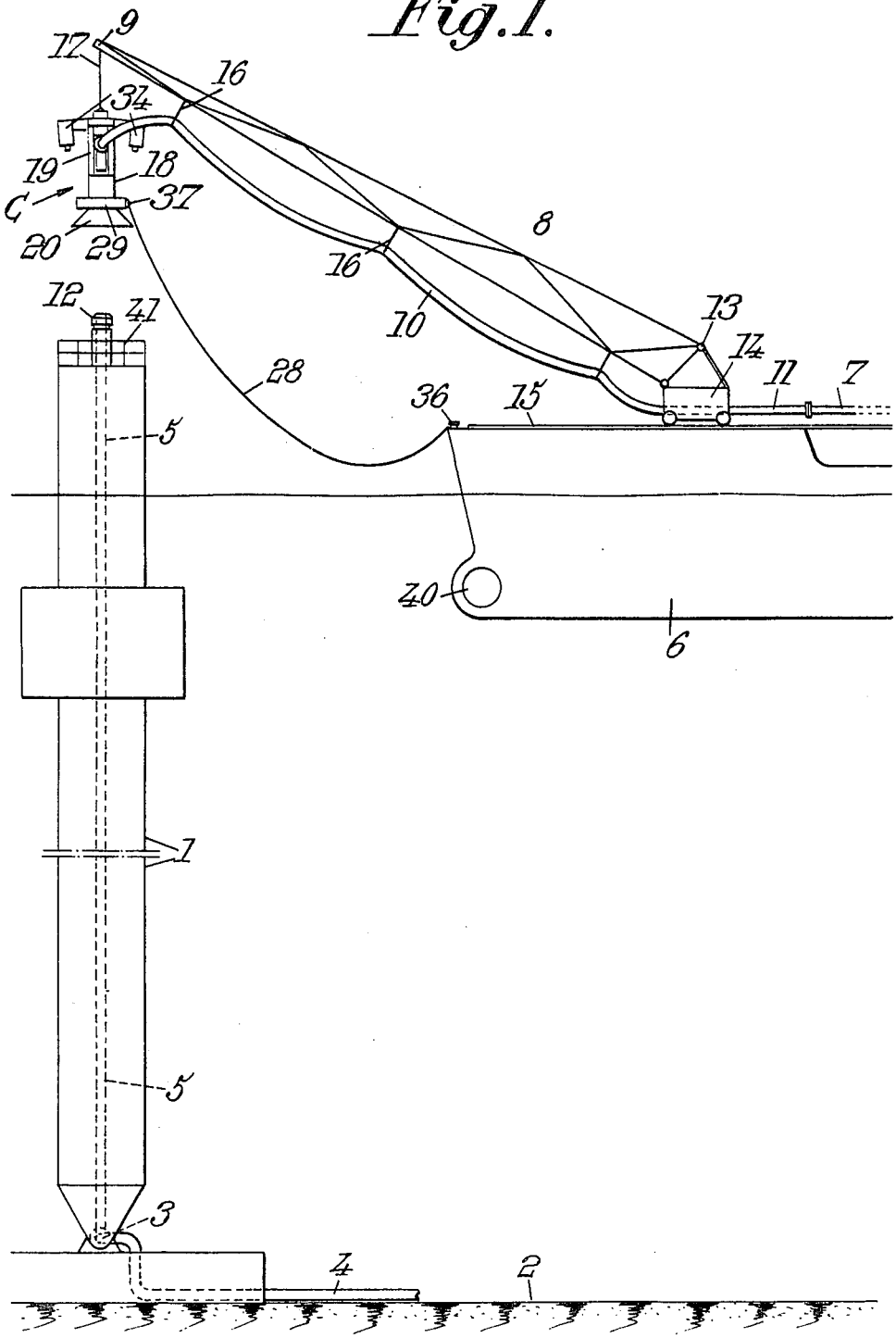
FIG. 1 is a diagrammatic elevational view, with removed portions of an assembly constituted by an oil-loading or storing column, a vessel and a system for mooring the latter and transferring the oil, the whole arrangement being designed according to the invention.

According to the invention, and according more specially to that form of application thereof, as well as those forms of embodiment of its various parts, which seem to deserve preference, considering an off-shore tower or column, e.g. a tower 1 (FIG. 1) pivotally mounted at 3 on the sea bed or ocean floor 2 and receiving oil through conduits or lines such as 4, 5, and purposing to provide means for mooring a ship or like floating vessel 6 and ensuring the transfer (in one direction or other depending upon the aim to be attained) between the conduit 5 and another conduit or line 7 secured to the vessel, one proceeds as follows or in a similar manner.

Use is made essentially, as shown by way of example in FIG. 1, of at least one arm 8 of suitable length, pivotally mounted on the vessel so as to be movable upward, downward or sidewise, the said arm carrying at its free end, at 9, a connector device C which, being connected to the bottom of the arm by a flexible or rigid conduit 10 which is itself adapted to be connected through a connection 11 to the conduit 7 carried by the vessel, is adapted to be placed above a nipple or like fitting mouth-piece or head carried by the platform at the upper end of pipe 5 and to ensure, by simple means preferably operated from the vessel, a fluid-tight connection with the said head.

To allow the connector device C to be correctly positioned above the head 12, the bottom end of the arm 8 is mounted at 13 by means of a double pivot joint, on a carriage 14 movable at will along rails 15 by appropriate operating means.

In the drawings, the pipe 10 supported at 16 by the arm 8 is assumed to be flexible. If it were rigid it might, if suitable, constitute part of the structure of the said arm, with rotary joints at its upper and lower ends.

Figure 2:
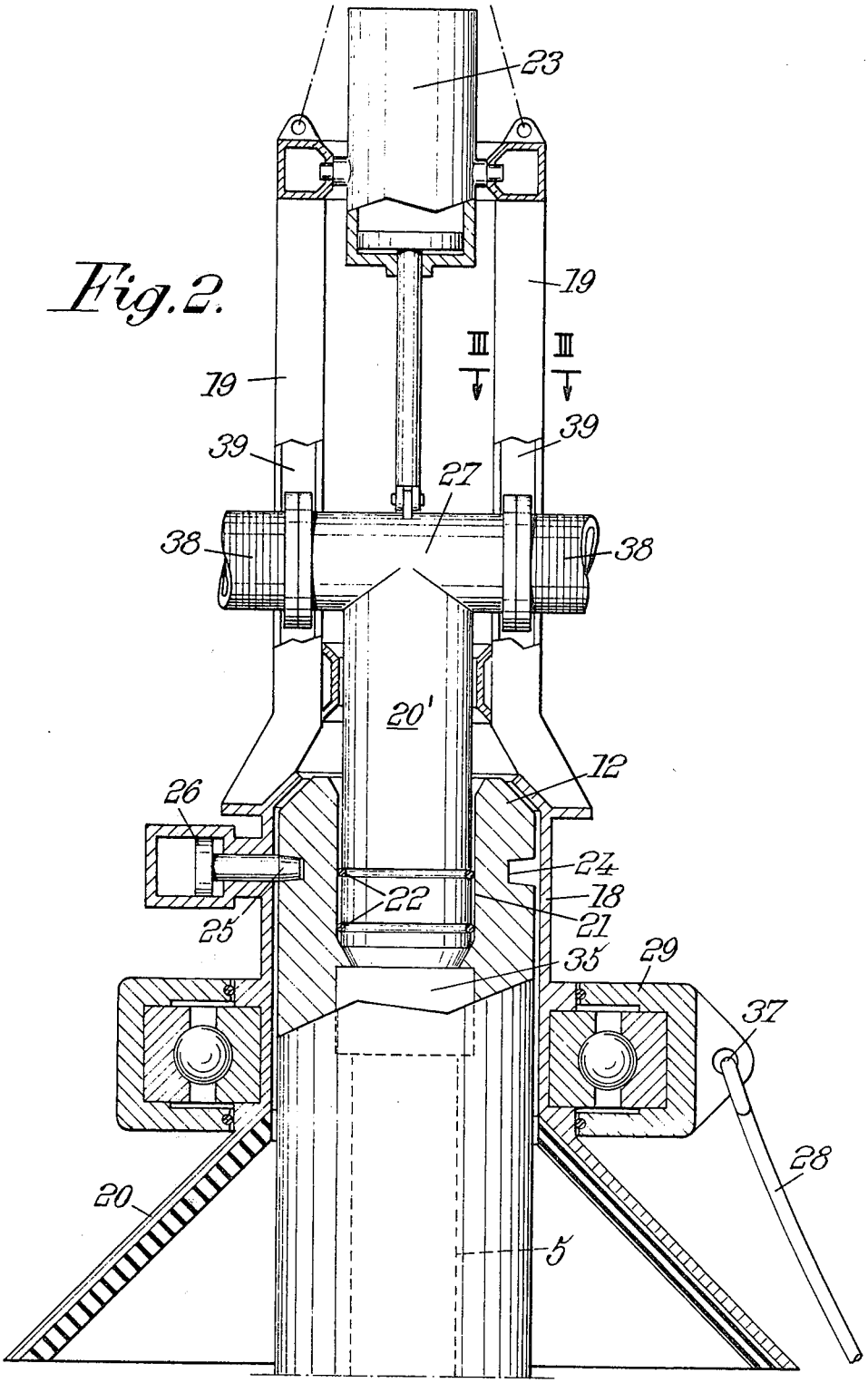
FIGS. 2 and 3 are separate views, to a larger scale, respectively, in vertical section with portions broken away and in section upon III—III of FIG. 2 of the connector elements mounted on the head of the column.
Figure 4:
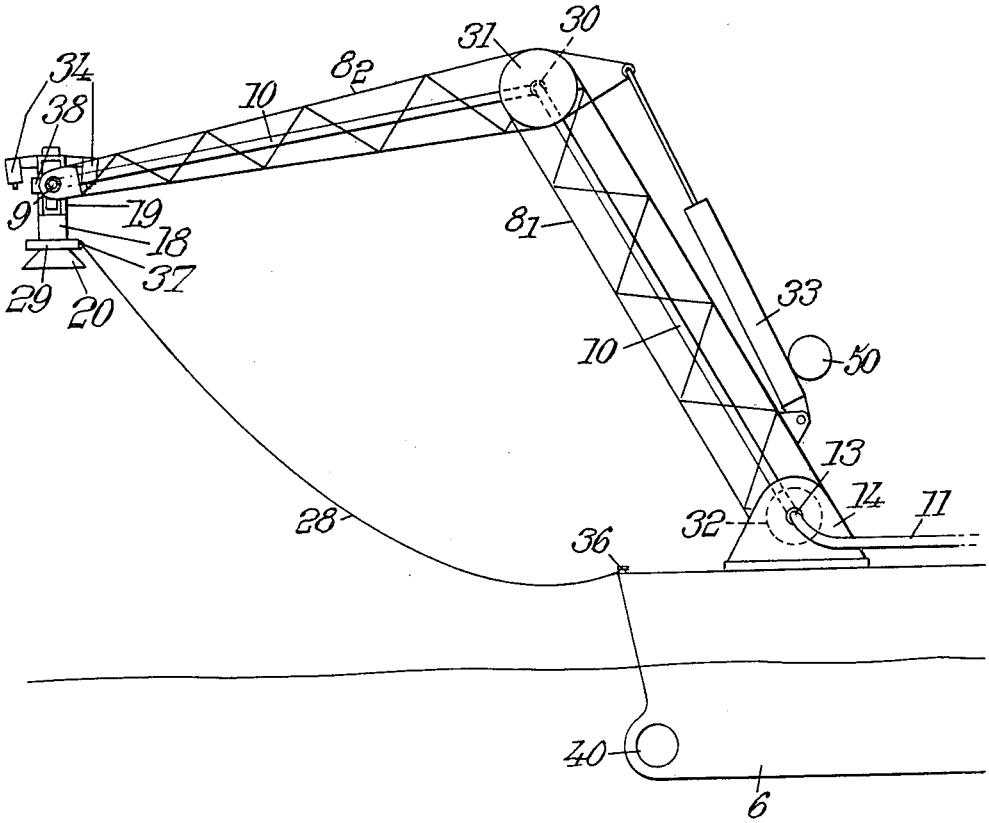
FIG. 4 is a view similar to FIG. 1 illustrating an assembly of the same kind, according to another form of embodiment of the invention.

As regards more specifically the connector device C, it is connected to the end 9 of arm 8 by a cable 17 (FIG. 1), of adjustable height if suitable, or by any other appropriate means such as for example a universal or Cardan joint 9 as assumed in FIG. 4, and it comprises for example:

- a hollow body or casing 18 supported at 19 (FIGS. 1 and 2), the said body, e.g. cylindrical in shape being adapted to be fitted with an appropriate clearance onto the head 12 of the column, and ending at its bottom with a guiding cone 20 facilitating the fitting onto the said column,
- a sliding hollow connector element such as a sleeve or hollow plunger 20' capable of serving as a male element with respect to the inlet 21 of the mouthpiece of the head 12, the said sleeve being provided with packing or sealing rings 22 (FIG. 2) and being remotely operated from the vessel, e.g. by means of an actuator 23 pivotally mounted within the support 19,
- and locking means adapted to co-operate, for example, with a lateral circular slot 24 provided on the head 12, the said locking means including particularly locks 25 operated by actuators 26 (FIG. 2).

The connection between the internal bore of sleeve 20' and the corresponding end of conduit 10 takes place for example through flexible pipes 38 connected to a tube section 27 issuing from the sleeve, but a rigid connection is not excluded, notably through the Cardan joint 9 in the case of FIG. 4.

Figure 3:
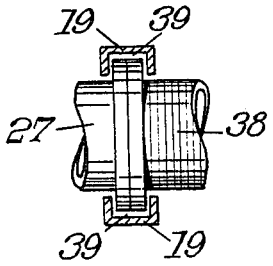

The T-shaped tube section 27, sliding for example with a clearance in appropriate guides 39 provided on the support 19 (FIG. 3), contributes together with the actuator 23 to a correct guiding of the sleeve 20' during the connecting and disconnecting operation.

Lastly, the form of embodiment of FIGS. 1 and 2 where the mooring of the vessel to the tower or column is by means of a hawser 28 one end of which is attached to the vessel at 36 and the other to the column at 37, the latter end of the said hawser is attached to a ring 29 rotatably mounted, by means of a ball or roller bearing, on the body 18 of connector C.

Another form of embodiment of the invention is illustrated in FIG. 4.

In this form of embodiment, the connector system C is pivotally mounted at the end of the pivoting arm which, in this case, is a double arm, the two elements $8_1$, $8_2$ of which are pivotally interconnected at 30, in combination with a servo-motor 31 or with any other suitable device such as for example a hydraulic actuator 33 allowing their respective directions to be modified at will by remote operation from the vessel. At 32 is diagrammatically shown the servo-motor which, as in the case of FIG. 1, allows the direction or orientation of the whole assembly to be adjusted both in vertical projection about an axis 13 and in horizontal projection, for example by rotating a turret 14 used instead of the carriage of FIG. 1.

Such an assembly solves the same problems as those of the assembly of FIG. 1. Moreover, it can be more easily retracted onto the vessel and if necessary moved to a collapsed position on the deck and firmly secured.

Owing to the fact that the assembly includes only rigid elements with pivotal joints or articulations, since the connector C is articulated at 9, the flexible hawser 28 can be done away with if desired, the said assembly being capable, once the connector is put in place, of itself fulfilling the function of a mooring arm. In this case, the carriage or the turret 14 may suitably be connected to the vessel by means of resilient mechanical, pneumatic, hydraulic or other means allowing the said carriage or the said turret to be subjected to certain displacements in the horizontal plane, particularly lengthwise of the vessel, thus replacing the resiliency of the missing hawser. All this is applicable to the case of FIG. 1, when the connector C is articulated at the end of its support arm.

It is also possible, for the same purpose, in the case of at least two arms such as $8_1$, $8_2$ operated by an actuator 33, to combine with the latter a hydraulic tensioning device such as diagrammatized at 50, e.g. of the oleo-pneumatic type, adapted to come into action once the connecting operation is completed (FIG. 3) and to produce an absorbing or damping effect with respect to the relative motions of the system of articulated arms, once the mooring and the connection are performed, under the action of the relative displacements of the oscillating tower or column 1 and the vessel 6 (pitching and rolling) under the action of sea heave.

The assemblies just described may include any additional means allowing for or facilitating the operations to be performed.

For example, the connector C, as represented in FIG. 1, may be provided with television means illustrated quite diagrammatically at 34 to improve the information of the man entrusted with the operation of the arm or the arms on the vessel and to thus facilitate correct positioning of the connector above the head 12.

Also provided, of course, is a double non-return or check valve mounted on the supply conduit 5 upstream of the head 12 as diagrammatized at 35 (FIG. 2).

Consequently, there is obtained an assembly for mooring the vessel and transferring the cargo, which allows the presence of any special equipment or any specialized personnel on the tower or column to be avoided and all the control or operating means to be placed on the vessel, the said assembly operating during the mooring in the following manner.

Considering for example the form of embodiment of FIGS. 1 and 2, the carriage 14 is first moved backward with respect to the head of the vessel, i.e. farther therefrom, so that the hawser 28 depending freely from the end of the arm, i.e. of the connector C at 37, and attached at its other end to the vessel at 36, is not tightened. The vessel then begins to manoeuvre, by means of a bow thruster 40, so as to move the end 9 nearer to the axis of the column. At the same time, an operator posted in a cabin at the head of the vessel ensures the necessary motions of both the carriage 14 and the arm 8 so as to obtain an accurate positioning, using the information provided by the television cameras 34 if any.

When the sleeve or hollow body 18 is correctly placed above the axis of the tower, the operator actuates the same in a rapid downward motion so as to fit it onto the head 12 of the column. This operation can be performed by the movements of the arms 8, in view of the presence of a clearance between the sleeve 18 and the head 12. It can also be performed, in the case of a connection by means of cable 17, as represented in FIG. 1, by releasing the said cable by means of appropriate operating means. A rigid extensible arm is also apt to perform this operation.

Once the sleeve 18 is put in place its locking is ensured by the servo-actuators 26 and, lastly, the sleeve 20 is actuated by actuator 23 to ensure the connection within the head 12.

The operator can then free the mechanisms which have been actuated for the positioning of the carriage 14 and the arm 8. Under the action of wind and current, the vessel moves further away while the carriage moves back in the opposite direction until the hawser 28 is stretched, thereby ensuring the mooring. Now, everything is ready for the transfer of the fluid.

The system of FIG. 4 operates in a similar manner, but with the possibility of eliminating the hawser 28 and also the possibility of more easily collapsing or retracting the set of arms $8_1$, $8_2$ to their transfer position on the vessel.

The invention as described offers a great number of advantages over the equipments of the kind in question already in existence, particularly:

that of allowing maximum simplification of the installation on the column, since the said installation can be limited to the existence of a fitting mouth-piece or head 12 around which it is possible to circulate, guard rails 41 being provided to this end, that, consequently, of limiting and even rendering unnecessary the presence of any personnel on the tower, that of allowing the equipment used on the vessel to be relatively simple, easy to handle and capable of being readily collapsed or folded up during transportation, and, in any case the maintenance of the said equipment to be ensured by the crew of the vessel, and that of making allowance for the relative displacements of the vessel and the tower so as to avoid dangerous strains being exerted on the articulated structure ensuring the mooring of the vessel and the transfer of the cargo, the resulting relative motions in the articulated elements of the said structure being absorbed, in particular, by the oleo-pneumatic or like device 50 and by the resiliency of the hawser if any.

Of course, the invention is by no means limited to the form of embodiment described and illustrated which has been given by way of example only. In particular it comprises all the means constituting technical equivalents to the means described as well as their combinations should the latter be carried out according to its gist and used within the scope of the following claims.

What is claimed is:

1. A system for mooring a ship or like floating vessel, in particular, an oil tanker, to an off-shore column, and for transferring a fluid cargo such as gas, petroleum oil or the like, by means of at least one articulated arm carried by said vessel, said arm supporting at its upper end a connector device capable of being fixedly placed on a mouth-piece provided on the head of said column, and mooring means for allowing said vessel, once the connector device is fixedly placed, to be moored through said device and to move around the latter so as to be placed in the wind's eye, said connector device comprising a hollow body forming a centering and guiding cone, adapted to be fitted onto a mouth-piece head extending from a conduit provided on said column, a sliding connector element operable to be inserted into the inlet of said mouth-piece in connecting relationship in conjunction with sealing means, locking means for maintaining the connecting condition of said connector device and said mouth-piece, and means for ensuring, once the connection is completed, the free rotation of said mooring means connecting said connector device to said vessel.

2. A system according to claim 1, comprising a hawser, wherein the hawser end which is adjacent to the tower is attached to a ring freely movable on said hollow body of said connector device.

3. A system according to claim 1, wherein said mooring is ensured only by said arm and said arm carrying said connector device is connected to the latter through a rotatable joint.

4. A system for mooring a ship or like floating vessel, in particular, an oil tanker, to an off-shore column, and for transferring a fluid cargo such as gas, petroleum oil or the like, by means of an arm comprising at least two articulated arm portions carried by said vessel through a turret-like swivelling head the base of which is secured to said vessel, said arm supporting at its upper free end a connector device capable of being fixedly placed on a mouth-piece provided on the head of said column, and mooring means for allowing said vessel, once the connector device is fixedly placed, to be moored through said device and to move around the latter so as to be placed in the wind's eye, said connector device comprising a hollow body forming a centering and guiding cone, adapted to be fitted onto said mouth-piece provided on said column, a sliding connector element operable to be inserted into the inlet of said mouth-piece in connecting relationship in conjunction with sealing means, locking means for maintaining the connecting condition of said connector device and said mouth-piece, and means for ensuring, once the connection is completed, the free rotation of said mooring means connecting said connector device to said vessel.

5. A system according to claim 4, wherein means are provided to allow, after the connection, for certain resilient displacements of the said turret-like swivelling head to withstand the mooring strain.

6. A system according to claim 4, wherein one of said arms is carried by said turret-like swivelling head, whereas the other is pivotally connected to the first one and movably connected through a universal joint to said connector device, in combination with means for opposing a damping effect to the relative rotation of both arms with respect to one another and for opposing the effects of sea heave.

7. A system according to claim 6, wherein said damping means comprise pneumatic-type tensioning means combined with an actuator for operating said arms.

* * * * *